US008618389B2

(12) United States Patent
Ryan

(10) Patent No.: US 8,618,389 B2
(45) Date of Patent: Dec. 31, 2013

(54) CAPO FOR STRINGED MUSICAL INSTRUMENTS

(76) Inventor: Benjamin B. Ryan, Santa Barbara, CA (US)

( * ) Notice: Subject to any disclaimer, the term of this patent is extended or adjusted under 35 U.S.C. 154(b) by 0 days.

(21) Appl. No.: 13/357,597

(22) Filed: Jan. 24, 2012

(65) Prior Publication Data

US 2013/0186256 A1 Jul. 25, 2013

(51) Int. Cl.
*G10D 3/00* (2006.01)

(52) U.S. Cl.
USPC ..... 84/318; 84/317

(58) Field of Classification Search
USPC ..... 84/318, 317
See application file for complete search history.

(56) References Cited

U.S. PATENT DOCUMENTS

| | | | | | |
|---|---|---|---|---|---|
| 1,094,038 | A | * | 4/1914 | Weaver et al. | 84/317 |
| 1,219,884 | A | | 3/1917 | Thingstad | |
| 1,553,057 | A | | 9/1925 | Weaver | |
| 1,785,311 | A | | 12/1930 | Johnson | |
| 1,823,683 | A | * | 9/1931 | Gardner, Jr. | 84/318 |
| 1,871,021 | A | | 8/1932 | Zachrison | |
| 2,669,151 | A | * | 2/1954 | Maccaferri | 84/317 |
| 2,744,433 | A | * | 5/1956 | Rooms | 84/315 |
| 3,446,108 | A | * | 5/1969 | Mitchell, Jr. | 84/317 |
| 3,680,427 | A | * | 8/1972 | Valentino | 84/456 |
| 3,704,646 | A | * | 12/1972 | Davis et al. | 84/454 |
| 3,805,664 | A | * | 4/1974 | Starns | 84/317 |
| 3,818,793 | A | | 6/1974 | Round | |
| 3,915,051 | A | * | 10/1975 | Kincaid | 84/317 |
| 4,183,279 | A | * | 1/1980 | Shabram, Jr. | 84/318 |
| 4,331,059 | A | * | 5/1982 | Marabotto | 84/317 |
| 4,334,457 | A | | 6/1982 | Spoonts, III | |
| 4,428,273 | A | * | 1/1984 | Favron | 84/317 |
| 4,622,880 | A | * | 11/1986 | Glemming et al. | 84/317 |
| 4,926,732 | A | * | 5/1990 | Collins et al. | 84/318 |
| 5,101,706 | A | * | 4/1992 | Kilgore | 84/318 |
| 5,323,676 | A | * | 6/1994 | Kennedy | 84/317 |
| 5,497,690 | A | | 3/1996 | Soupios | |

(Continued)

FOREIGN PATENT DOCUMENTS

KR 10-2001-0086958 A 9/2001

OTHER PUBLICATIONS

"The Spider Capo by Creative Tunings", Apr. 18, 2010, retrieved at <<http://www.guitarlicksandtips.com/2010/04/18/the-spider-capo/>>.

(Continued)

*Primary Examiner* — Robert W Horn
(74) *Attorney, Agent, or Firm* — Lyon & Harr, LLP; Richard T. Lyon

(57) ABSTRACT

A tuning apparatus for a musical instrument is provided. The instrument includes a neck having a front surface over which a plurality of strings is stretched. The apparatus includes a clamp and a plurality of string-contacting members. The clamp is adapted to removably attach to a desired longitudinal position on the neck. Each of the members is rotatably supported by the clamp and is adapted to rotate on the clamp independently of the other members, this rotation occurring along a plane which is substantially parallel to either a given string or course of strings. Each of the members is further adapted to adjustably impinge upon and urge the given string or course of strings toward a user-selectable one of three different longitudinal positions on the front surface, these positions including a home position, a home−1 position, and a home+1 position.

20 Claims, 8 Drawing Sheets

(56) References Cited

U.S. PATENT DOCUMENTS

| | | | | |
|---|---|---|---|---|
| 5,623,110 | A * | 4/1997 | Hoglund et al. | 84/318 |
| 6,723,905 | B2 * | 4/2004 | Gillis | 84/318 |
| 6,998,526 | B1 * | 2/2006 | Sims et al. | 84/318 |
| 7,012,181 | B2 * | 3/2006 | Tran | 84/318 |
| 7,557,285 | B2 | 7/2009 | Ward | |
| 7,563,969 | B2 * | 7/2009 | Einhorn et al. | 84/318 |
| 7,812,233 | B1 * | 10/2010 | Lee | 84/317 |
| D669,117 | S * | 10/2012 | de Neufville | D17/20 |
| 2005/0145089 | A1 * | 7/2005 | Davis | 84/318 |
| 2010/0077901 | A1 * | 4/2010 | Artioli | 84/318 |
| 2013/0186256 | A1 * | 7/2013 | Ryan | 84/318 |

OTHER PUBLICATIONS

"SpiderCapo(TM)", Sep. 19, 2011, retrieved at <<http://spidercapo.com/>>.

PCT—Notification of Transmittal of the ISR & WO, ISR and WO, International Security Authority, May 15, 2013, 9 pages.

* cited by examiner

CAPO FOR STRINGED MUSICAL INSTRUMENTS

BACKGROUND

As is appreciated in the art of musical instruments, a capo (also formally known as either a "capodastro" or a "capotasto") can be attached to the neck of a stringed musical instrument in order to shorten the playable length (i.e., the effective length) of selected strings of the instrument without a user having to apply finger pressure to the selected strings. A capo can thus be used to alter the sound of selected strings of a stringed musical instrument by upwardly transposing the pitch of the sound the selected strings will generate whenever the user applies energy to them by either plucking them, or striking them, or strumming them, or bowing them, or the like.

SUMMARY

This Summary is provided to introduce a selection of concepts, in a simplified form, that are further described hereafter in the Detailed Description. This Summary is not intended to identify key features or essential features of the claimed subject matter, nor is it intended to be used as an aid in determining the scope of the claimed subject matter.

Capo embodiments described herein generally involve a tuning apparatus for a musical instrument, where the musical instrument includes an elongated neck having a front surface over which a plurality of strings is stretched. In an exemplary embodiment the tuning apparatus includes a clamp and a plurality of string-contacting members. The clamp is adapted to removably attach to a desired longitudinal position on the neck. Each of the string-contacting members is rotatably supported by the clamp and is adapted to rotate thereon independently of the other string-contacting members, where this rotation occurs along a plane which is substantially parallel to either a given string or course of strings. Each of the string-contacting members is further adapted to adjustably impinge upon and urge the given string or course of strings toward a user-selectable one of three different longitudinal positions on the front surface of the neck, where these positions include a home position, a home−1 position which is closer to a headstock end of the neck than the home position, and a home+1 position which is farther from the headstock end of the neck than the home position.

DESCRIPTION OF THE DRAWINGS

The specific features, aspects, and advantages of the capo embodiments described herein will become better understood with regard to the following description, appended claims, and accompanying drawings where:

DETAILED DESCRIPTION

Figure 1:
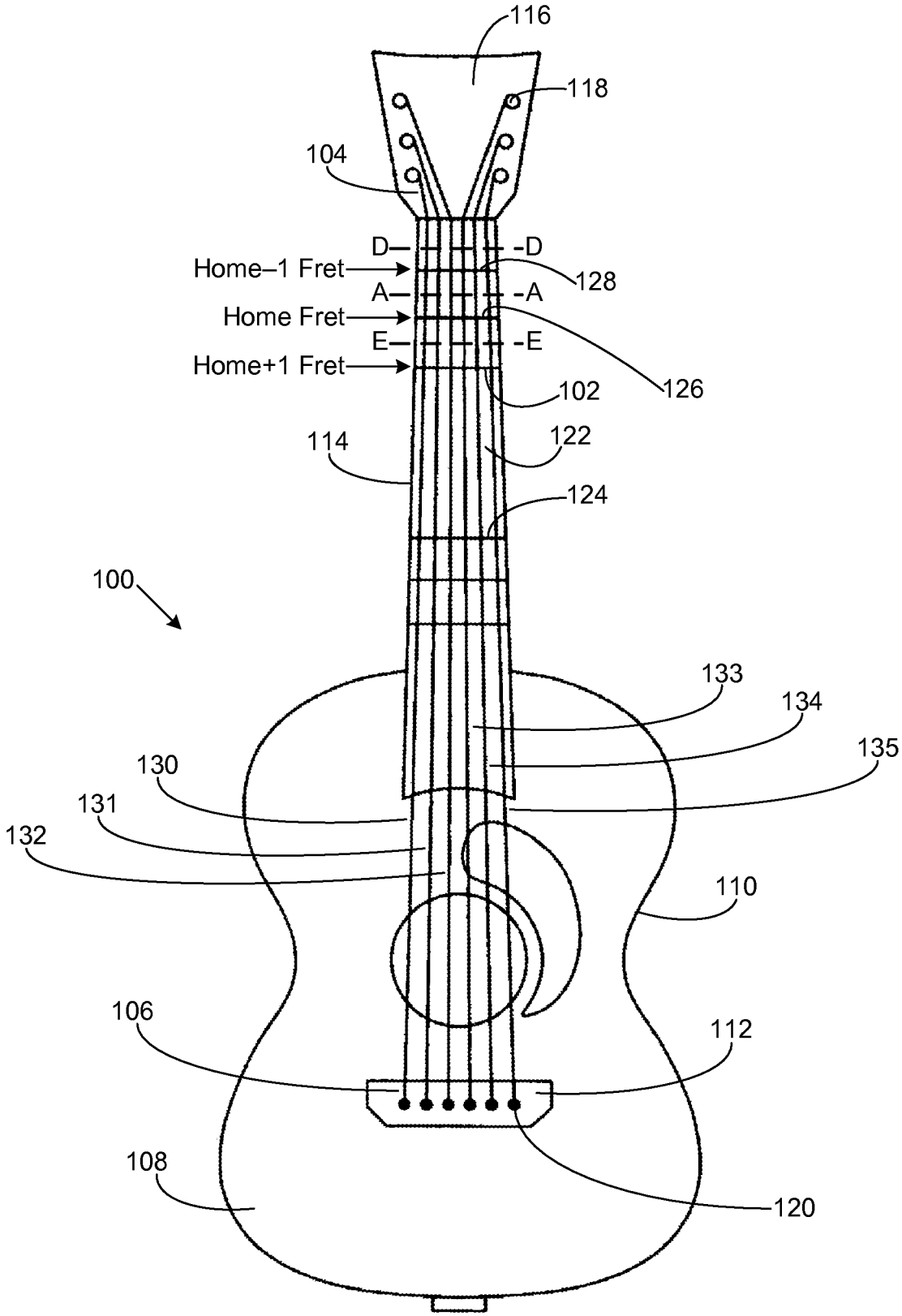
FIG. 1 is a diagram illustrating a front plan view, in simplified form, of an exemplary embodiment of a stringed musical instrument to which the capo embodiments described herein can be removably attached by a user.

In the following description of capo embodiments reference is made to the accompanying drawings which form a part hereof, and in which are shown, by way of illustration, specific embodiments in which the capo can be practiced. It is understood that other embodiments can be utilized and structural changes can be made without departing from the scope of the capo embodiments. The term "open position" is used herein to refer to a situation where a given string of a stringed musical instrument is not currently being impinged upon and urged (either by a user or by the capo embodiments) toward a front surface of an elongated neck of the instrument (i.e., the string is in its natural state). Correspondingly, the term "closed position" is used herein to refer to another situation where a given string of the instrument is currently being impinged upon and urged (again either by the user or by the capo embodiments) toward this front surface.

1.0 Stringed Musical Instruments

The term "stringed musical instrument" is used herein to refer to any type of musical instrument having an elongated neck which includes a longitudinal axis and a front surface over which a plurality of strings is stretched. As is appreciated in the art of musical instruments, the front surface of the neck commonly includes a plurality of frets. A user can use finger pressure to temporarily impinge upon and urge one or more selected strings toward selected points on the front surface of the neck. In the case where the front surface of the neck includes frets, this finger pressure will result in the selected strings being temporarily pressed onto the frets that are adjacent to these selected points, which serves to shorten the playable length (herein also referred to as the "effective length") of the selected strings. This finger pressure will thus serve to upwardly transpose the pitch of the sound the selected strings will generate whenever the user applies energy to them by either plucking them, or striking them, or strumming them, or bowing them, or the like.

As is also appreciated in the art of musical instruments, there are many different types of stringed musical instruments having various numbers of strings. Popular examples of stringed musical instruments include the following. Bass guitars commonly have either four, or five, or six strings. Electric guitars and acoustic guitars commonly have either six or 12 strings. Banjos commonly have either four, or five, or six strings. Mandolins commonly have eight strings. Lutes commonly have either 13, or 15, or 24 strings. As is also appreciated in the art of musical instruments, the strings of a given stringed musical instrument can also be arranged into a plurality of courses where each of the courses includes a different and non-overlapping subset of the strings. By way of example but not limitation, the strings of a 12-string electric or acoustic guitar are commonly arranged into six courses (i.e., the 12 strings are arranged as six pairs of strings) as follows. The first course includes the first and second strings, the second course includes the third and fourth strings, the third course includes the fifth and sixth strings, the fourth course includes the seventh and eighth strings, the fifth course includes the ninth and tenth strings, and the sixth course includes the eleventh and twelfth strings.

As is also appreciated in the art of musical instruments, the elongated necks of the different types of stringed musical instruments can have different widths, thicknesses and cross-sectional shapes. The location of the frets on the front surface of the neck and the spacing between the various frets can be different on the different types of instruments. The spacing in-between the strings can also be different on the different types of instruments. The spacing between the left/right edge of the neck and the leftmost/rightmost string can also be different on the different types of instruments. The distance between any given string and the front surface of the neck can also be different on the different types of instruments (i.e., different types of instruments can have different actions).

FIG. 1 illustrates a front plan view, in simplified form, of an exemplary embodiment of a stringed musical instrument to which the capo embodiments described herein can be removably attached by a user. The stringed musical instrument exemplified in FIG. 1 is an acoustic guitar 100 which is generally configured as follows. The guitar includes a soundboard 108, a resonant chamber 110, a bridge 112, an elongated neck 114, a headstock 116, and a prescribed number of strings (six in the illustrated embodiment, namely strings 130-135) each having a first end 104 and a second end 106. The bridge is commonly rigidly attached to the soundboard. The soundboard is rigidly attached to the resonant chamber. One end of the neck is rigidly attached to the soundboard and resonant chamber. The other end of the neck is rigidly attached to the headstock. The headstock includes the prescribed number of tuning pegs 118, where each of the tuning pegs is rotatably attached to a different prescribed position on the headstock. The bridge includes the prescribed number of anchor pegs 120 (or any like bridge fastening mechanisms), where each of the anchor pegs is rigidly attached to a different prescribed position on the bridge.

As exemplified in FIG. 1, the first end 104 of each of the strings 130-135 on the acoustic guitar 100 is securely attached to a different tuning peg 118, and the second end 106 of each of the strings is securely attached to a different anchor peg 120. The user can rotate selected tuning pegs in order to stretch each of the strings to a prescribed tension between the bridge 112 and headstock 116. The user can thus individually tune the strings of the guitar by rotating the tuning peg each string is attached to and thus adjusting the amount of tension that is applied to the string. The elongated neck 114 of the guitar includes a front surface 122 which may include a plurality of frets (e.g., frets 124, 126, 128 and 102) each having a raised edge, where the frets are sequentially disposed in different prescribed positions along a longitudinal axis of the neck on the front surface of the neck, and each of the frets is substantially perpendicular to this axis. The frets serve to divide the front surface of the neck into sections.

Referring again to FIG. 1, the headstock 116, tuning pegs 118, elongated neck 114, frets (e.g., fret 124), bridge 112 and anchor pegs 120 are arranged such that the strings 130-135 have the following spatial relationships on the acoustic guitar 100. The strings are disposed in substantially parallel spaced relation to the longitudinal axis of the neck. The strings are also disposed in spaced relation to the front surface 122 of the neck. The distance between any given string and the front surface of the neck is known as the "action." The raised edge of each of the frets is in transverse relation to each of the strings. Each of the strings is separated from the raised edge of each of the frets by a prescribed distance when each of the strings is in an open position (i.e., when none of the strings are currently being impinged upon and urged toward the front surface of the neck). The user can change the note a given string will generate by urging the string toward the front surface of the neck between a selected pair of adjacent frets.

As is appreciated in the art of musical instruments, the strings of a stringed musical instrument are predominately tuned in what is known as a "standard tuning" where, generally speaking, the strings are individually tuned by rotating the tuning pegs as just described such that the sound generated by each of the strings is a prescribed tonal interval away from the sound generated by the adjacent strings. As such, the user of the instrument generally learns to play it using conventional fingering patterns to generate standard chords, standard scales and standard harmonic patterns. Whenever the instrument is tuned in the standard tuning, the user needs to use finger pressure to impinge upon and urge selected strings toward selected points on the front surface of the neck in order to play a specific chord or scale.

As is also appreciated in the art of musical instruments, the strings of a stringed musical instrument can also be tuned in various other ways such as what are commonly referred to as "alternative tunings" and "open tunings". Generally speaking, in the alternative and open tunings the tonal intervals between one or more pairs of adjacent strings are modified from the prescribed tonal intervals used in the standard tuning. Thus, the alternative and open tunings can be employed to produce noticeable variations in the sounds and harmonies that are generated by the instrument. Whenever the instrument is tuned in an alternative or open tuning, the user can play a specific chord with all the strings in the open position (i.e., the user does not need to use finger pressure to impinge upon and urge any of the strings toward the front surface of the neck in order to play a specific chord). However, since the tonal intervals between the various strings are modified from the prescribed tonal intervals used in the standard tuning, the user needs to use fingering patterns which are different from the conventional fingering patterns in order to generate the standard chords, standard scales and standard harmonic patterns. Additionally, different fingering patterns are associated with each of the different alternative and open tunings. In recent years there has been a substantial increase in the interest in alternative and open tunings from the perspective of both users of stringed musical instruments and listeners.

Various methods can be employed to change the tuning of the strings of a stringed musical instrument from the standard tuning to a desired alternative or open tuning. One such method is to use the tuning pegs of the instrument to modify the amount of tension that is applied to selected strings as just described. Another such method is to employ the capo embodiments described herein. More particularly and as will be described in more detail hereafter, in the aforementioned case where the front surface of the elongated neck of the instrument includes frets, the capo embodiments can be removably attached to a desired longitudinal position on the elongated neck of the instrument such that a first shaft of the capo embodiments is substantially parallel to and approximately midway between a selected pair of adjacent frets on this front surface. The particular fret in the selected pair that is closest to the bridge of the instrument is hereafter referred to as a "home fret." The other fret in the selected pair (i.e., the particular fret in the selected pair that is closest to the headstock of the instrument) is hereafter referred to as a "home−1 fret." The particular fret on this front surface that is adjacent to the home fret on a side thereof that is opposite the home−1 fret is hereafter referred to as a "home+1 fret." By way of example but not limitation and referring again to FIG. 1 and, the capo embodiments (not shown) can be removably attached to the neck 114 of the acoustic guitar 100 such that the first shaft of the capo embodiments is in the position indicated by line A-A. In this particular case fret 126 would be the home fret, fret 128 would be the home−1 fret, and fret 102 would be the home+1 fret.

2.0 Capo for Stringed Musical Instruments

The capo embodiments described herein generally involve an accessory/auxiliary tuning apparatus for a stringed musical instrument having a plurality of strings. The apparatus is generally applicable to either changing the tuning of any individual string on demand, or changing the tuning of any combination of two or more strings at the same time on demand, where these tuning changes occur without having to use the instrument's tuning pegs to modify the amount of tension that is applied to any of the strings (i.e., without having to modify the actual tuning of any of the strings).

More particularly and as will be described in more detail hereafter, once the capo embodiments described herein have been removably attached to a desired longitudinal position on the elongated neck of the instrument such that the first shaft of the capo embodiments is substantially parallel to and approximately midway between a selected pair of adjacent frets on the front surface of the neck, the user of the instrument can configure the capo embodiments on demand to shorten the effective length of either any individual string, or any combination of two or more strings at the same time, where this shortening takes place on each of the strings independently and within a span of three contiguous frets. In other words, the user can configure the capo embodiments to releasably depress any individual string onto any desired fret within the span of three contiguous frets. The user can also configure the capo embodiments to releasably depress any combination of two or more strings at the same time either onto any desired single fret within the span of three contiguous frets, or onto any combination of desired frets within this span. This ability to shorten the effective length of any selected combination of two or more strings at the same time onto a plurality of different frets allows entire chords to be generated by the capo embodiments.

The capo embodiments described herein are advantageous for various reasons including, but not limited to, the following. Generally speaking and as will be appreciated from the more detailed description that follows, the capo embodiments allows the user to enhance their musical performance and related enjoyment in various ways when playing the instrument. The capo embodiments ensure reliable and consistent positioning thereof on the instrument's neck, and against the strings and the front surface of the neck. The capo embodiments are cost effective, durable, and aesthetically pleasing. The capo embodiments are easy to use, and are effective in various instrument playing scenarios such as practicing, teaching, and live performance, among others. The capo embodiments can be repeatedly securely attached to and removed from the neck without damaging it or its finish (e.g., without scratching, nicking or denting the neck), and without damaging any other part of the instrument. Similarly, the capo embodiments can be repeatedly used to change the tuning of the instrument's strings without any wear or damage occurring to the instrument or strings. The capo embodiments are expandable and adjustable, which makes them compatible with a wide variety of different types of stringed musical instruments including, but not limited to, the various exemplary types described heretofore. The capo embodiments are also compatible with all types of strings.

As will also be appreciated from the more detailed description that follows, the user of a stringed musical instrument can quickly and securely attach the capo embodiments described herein to the instrument's neck with ease, simplicity and integrity whenever they want to change the tuning of the instrument's strings from the standard tuning to an alternate or open tuning. Once the capo embodiments have been attached to the neck, the user can use the capo embodiments to easily, reliably and quickly switch from the standard tuning to any one of a very large number of alternative and open tunings on demand, or switch from one particular alternative or open tuning to another on demand, or switch from a particular alternative or open tuning back to the standard tuning on demand, all without having to change the actual tuning of the strings. By way of example but not limitation, in an exemplary situation where the capo embodiments are attached to the neck of a six string guitar, the user can use the capo embodiments to easily, reliably and quickly switch between $2^{24}$=16,777,216 different possible tunings on the guitar. The user can also easily and quickly remove the capo embodiments from the neck at will.

As will also be appreciated from the more detailed description that follows, when the capo embodiments described herein are used to implement a selected alternative or open tuning on a stringed musical instrument, the user of the instrument can continue to play it in the selected tuning using the aforementioned conventional fingering patterns they already know (or using simple variations thereof). In other words, the capo embodiments eliminate the need for the user to have to learn new chord and scale fingering patterns for each of the different alternative or open tunings they are interested in using on the instrument. Thus, the capo embodiments allow the user to experiment with the instrument and easily generate a vast array of pleasing and harmonically complex new sounds and musical arrangements, which are quite different from the sounds and arrangements that can be generated using just the standard tuning, without having to change the actual tuning of the instrument's strings or learn new chord and scale fingering patterns. The capo embodiments thus allow the user to conveniently add new tonal dimensions to their existing musical repertoire and express new musical ideas.

As will also be appreciated from the more detailed description that follows, the capo embodiments described herein have an ergonomic design that maximizes the user's accessibility to the various strings and frets of their stringed musical instrument, and minimizes any encumbrance the user might experience when the capo embodiments are attached to the instrument's neck. In other words, the capo embodiments do not impede or interfere with the user's hands or their ability to reach any desired fret (with the exception of the aforementioned home fret) on any string, regardless of which if any strings are currently being impinged upon and urged toward the front surface of the instrument's neck by the capo embodiments.

Figure 2:
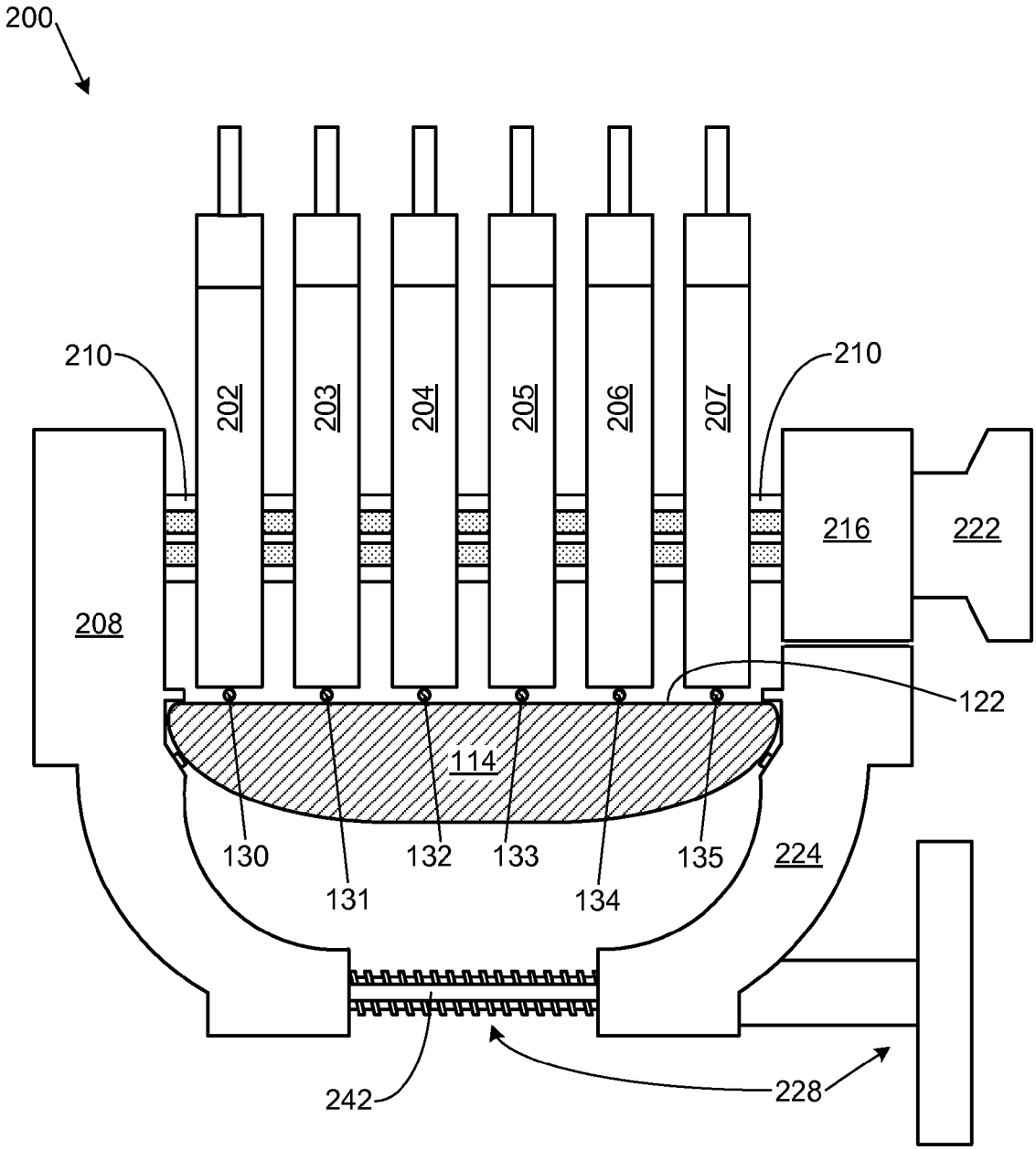
FIG. 2 is a diagram illustrating a front plan view, in simplified form, of an exemplary embodiment of the capo which includes a clamp and a plurality of string-contacting members, where each of the string-contacting members is in a home rotational orientation and is impinging upon and urging a given string of the stringed musical instrument toward a home position on a front surface of an elongated neck of the instrument.
Figure 3:
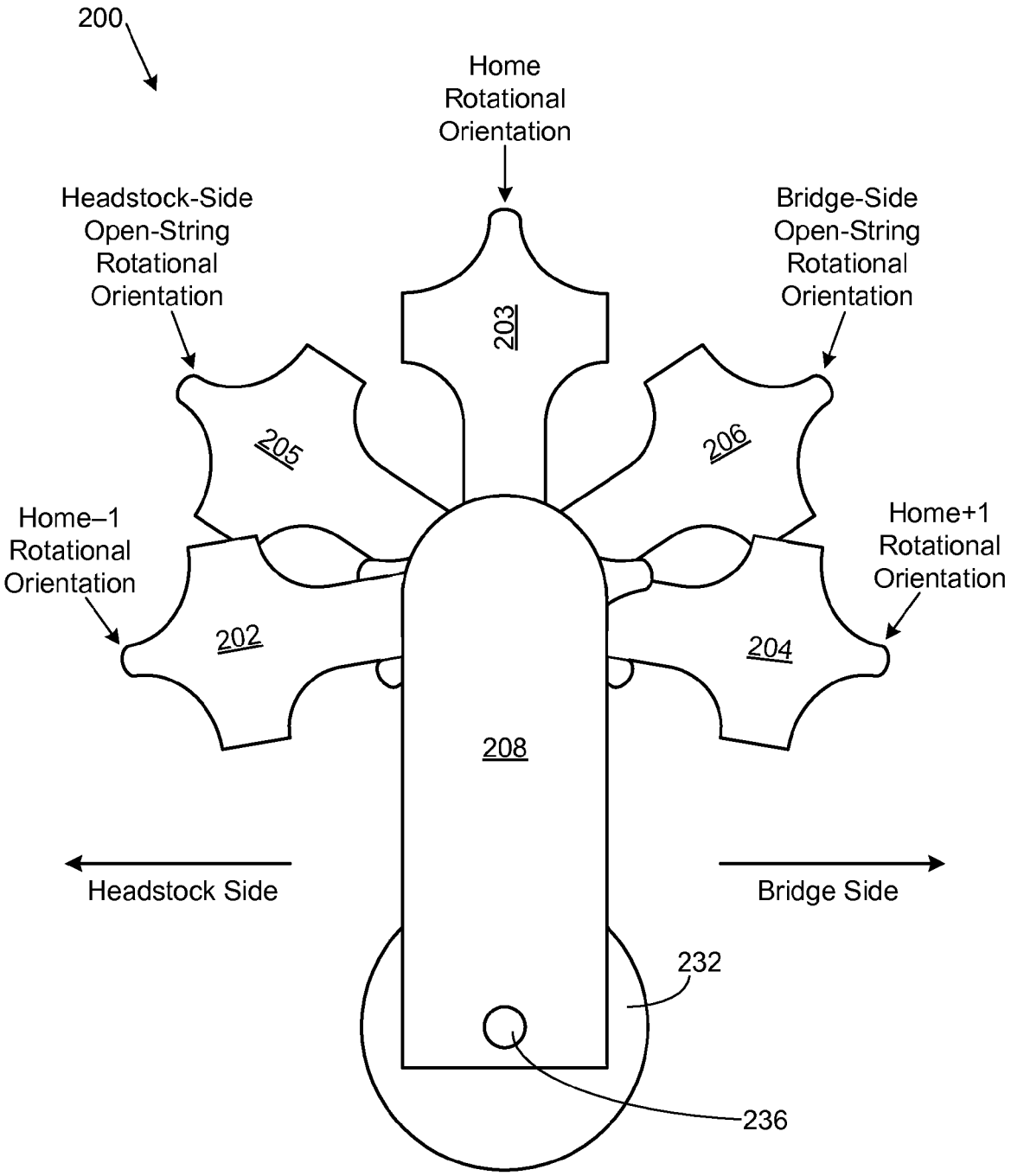
FIG. 3 is a diagram illustrating a plan view, in simplified form, of the capo of FIG. 2 rotated right 90 degrees, where some of the string-contacting members are in a home−1 rotational orientation, some of the string-contacting members are in a headstock-side open-string rotational orientation, some of the string-contacting members are in the home rotational orientation, some of the string-contacting members are in a bridge-side open-string rotational orientation, and some of the string-contacting members are in a home+1 rotational orientation.

FIGS. 2, 3, 4A, 4B, 5A, 5B, 6A, 6B, 7A, 7B, 8A, 8B, 9A, 9B, 10A, 10B and 12 illustrate an exemplary embodiment, in simplified form, of the aforementioned tuning apparatus for a stringed musical instrument (hereafter simply referred to as a "tuning apparatus"). More particularly, FIG. 2 illustrates a front plan view of an exemplary embodiment of the tuning apparatus 200 which includes a clamp and a plurality of string-contacting members (six in the illustrated embodiment, namely string-contacting members 202-207), where each of the string-contacting members is in a home rotational orientation and is impinging upon and urging a given string 130-135 of the instrument toward a home position on a front surface 122 of the elongated neck 114 of the instrument. The clamp is herein also referred to as a "neck-gripping means". Each of the string-contacting members is herein also referred to as a "string-depressing means." FIG. 3 illustrates a plan view of the tuning apparatus 200 of FIG. 2 rotated right 90 degrees, where some of the string-contacting members are in a home−1 rotational orientation (e.g., member 202), some of the string-contacting members are in an optional headstock-side open-string rotational orientation (e.g., member 205), some of the string-contacting members are in the home rotational orientation (e.g., member 203), some of the string-contacting members are in an optional bridge-side open-string rotational orientation (e.g., member 206), and some of the string-contacting members are in a home+1 rotational orientation (e.g., member 204).

Figure 4A:
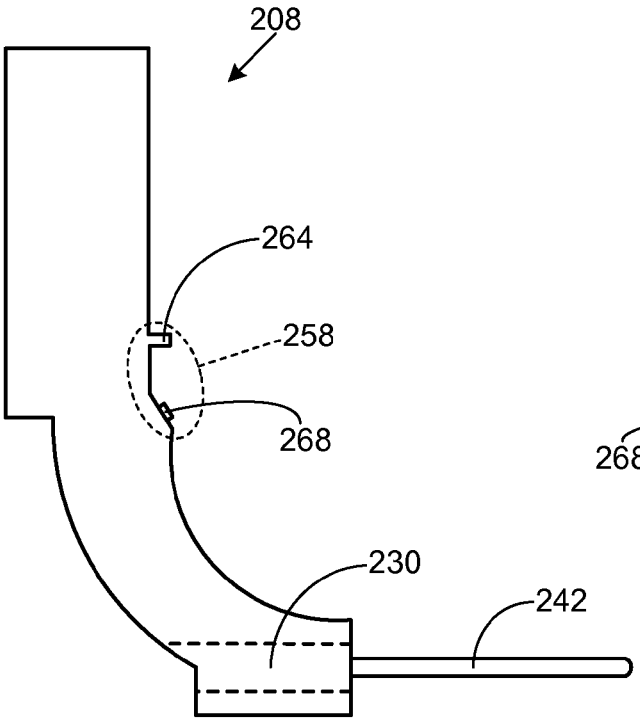
FIG. 4A is a diagram illustrating a standalone transparent plan view, in simplified form, of an exemplary embodiment of a left jaw of the clamp of FIG. 2.
Figure 4B:
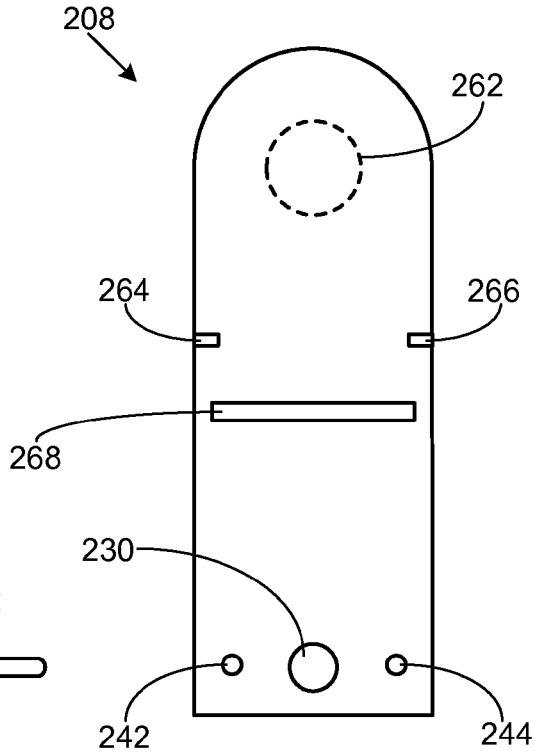
FIG. 4B is a diagram illustrating a transparent plan view, in simplified form, of the left jaw of FIG. 4A rotated left 90 degrees.
Figure 5A:
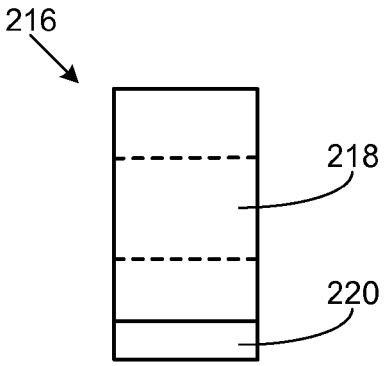
FIG. 5A is a diagram illustrating a standalone transparent plan view, in simplified form, of an exemplary embodiment of a collar of the clamp of FIG. 2.
Figure 5B:
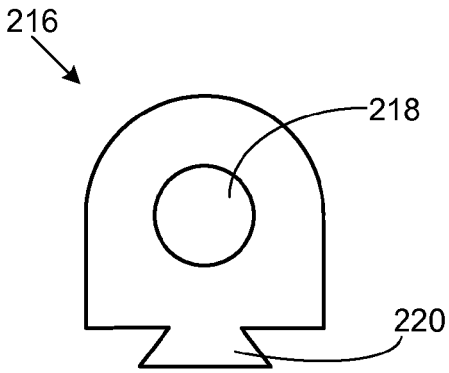
FIG. 5B is a diagram illustrating a plan view, in simplified form, of the collar of FIG. 5A rotated left 90 degrees.
Figure 6A:
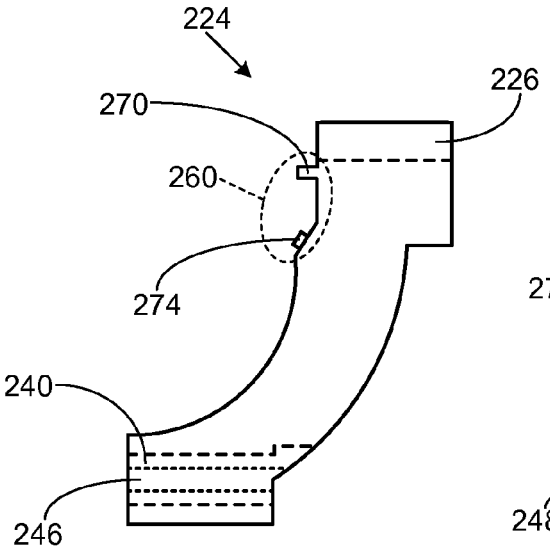
FIG. 6A is a diagram illustrating a standalone transparent plan view, in simplified form, of an exemplary embodiment of a right jaw of the clamp of FIG. 2.
Figure 6B:
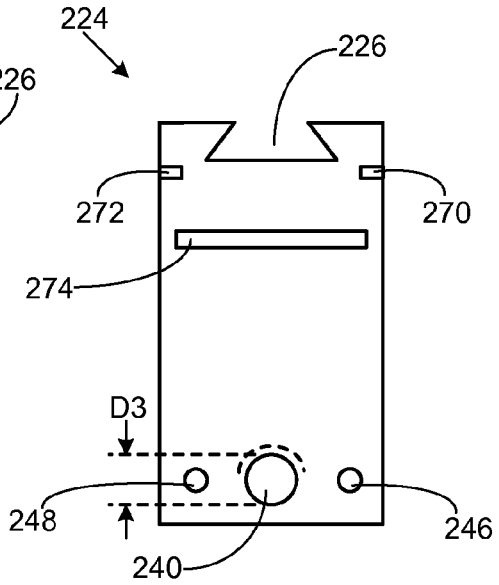
FIG. 6B is a diagram illustrating a transparent plan view, in simplified form, of the right jaw of FIG. 6A rotated right 90 degrees.
Figure 7A:
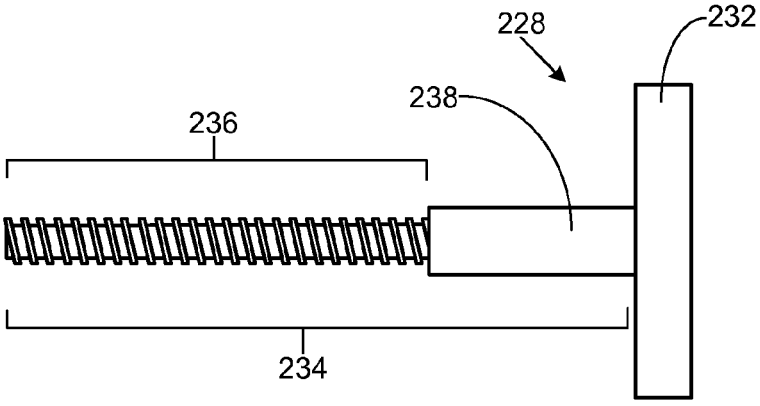
FIG. 7A is a diagram illustrating a standalone plan view, in simplified form, of an exemplary embodiment of a jaw-tightening member of the clamp of FIG. 2.
Figure 7B:
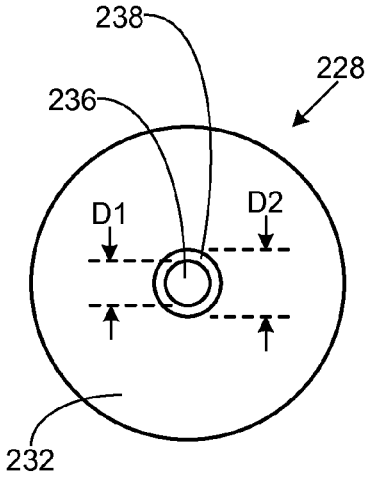
FIG. 7B is a diagram illustrating a plan view, in simplified form, of the jaw-tightening member of FIG. 7A rotated right 90 degrees.
Figure 8A:
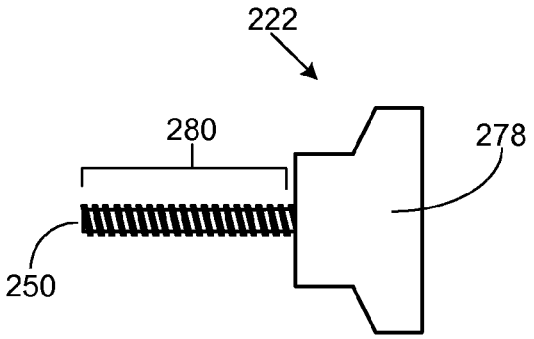
FIG. 8A is a diagram illustrating a standalone plan view, in simplified form, of an exemplary embodiment of a collar-tightening member of the clamp of FIG. 2.
Figure 8B:
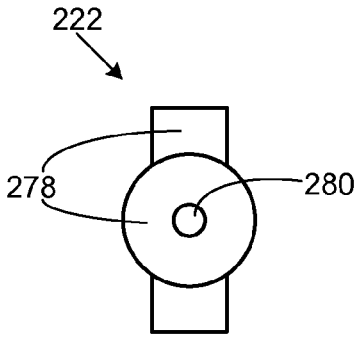
FIG. 8B is a diagram illustrating a plan view, in simplified form, of the collar-tightening member of FIG. 8A rotated right 90 degrees.
Figure 9A:
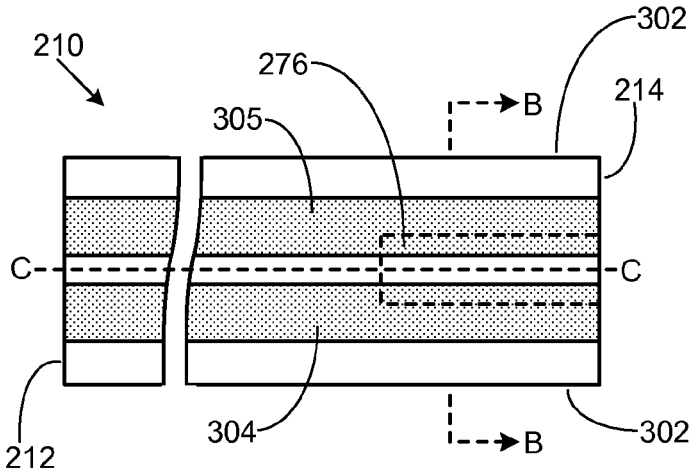
FIG. 9A is a diagram illustrating a standalone plan view, in simplified form, of an exemplary embodiment of a shaft of the clamp of FIG. 2.
Figure 9B:
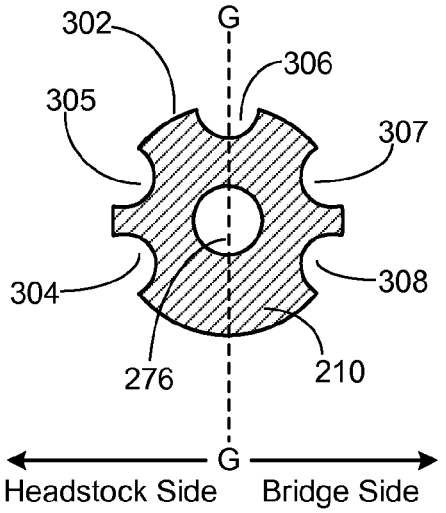
FIG. 9B is a diagram illustrating a cross-sectional view, in simplified form, of the shaft taken along line B-B of FIG. 9A.
Figure 10A:
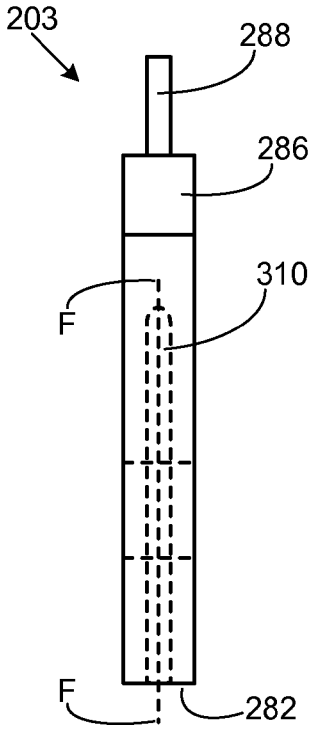
FIG. 10A is a diagram illustrating a standalone transparent plan view, in simplified form, of an exemplary embodiment of one of the string-contacting members of FIG. 2.
Figure 10B:
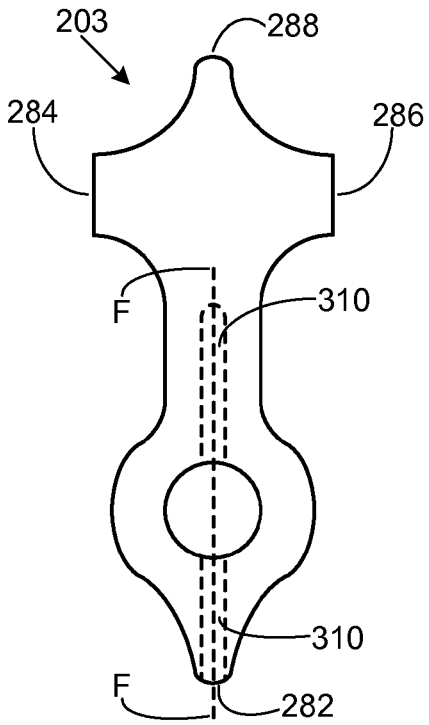
FIG. 10B is a diagram illustrating a transparent plan view, in simplified form, of the string-contacting member of FIG. 10A rotated right 90 degrees.
Figure 12:
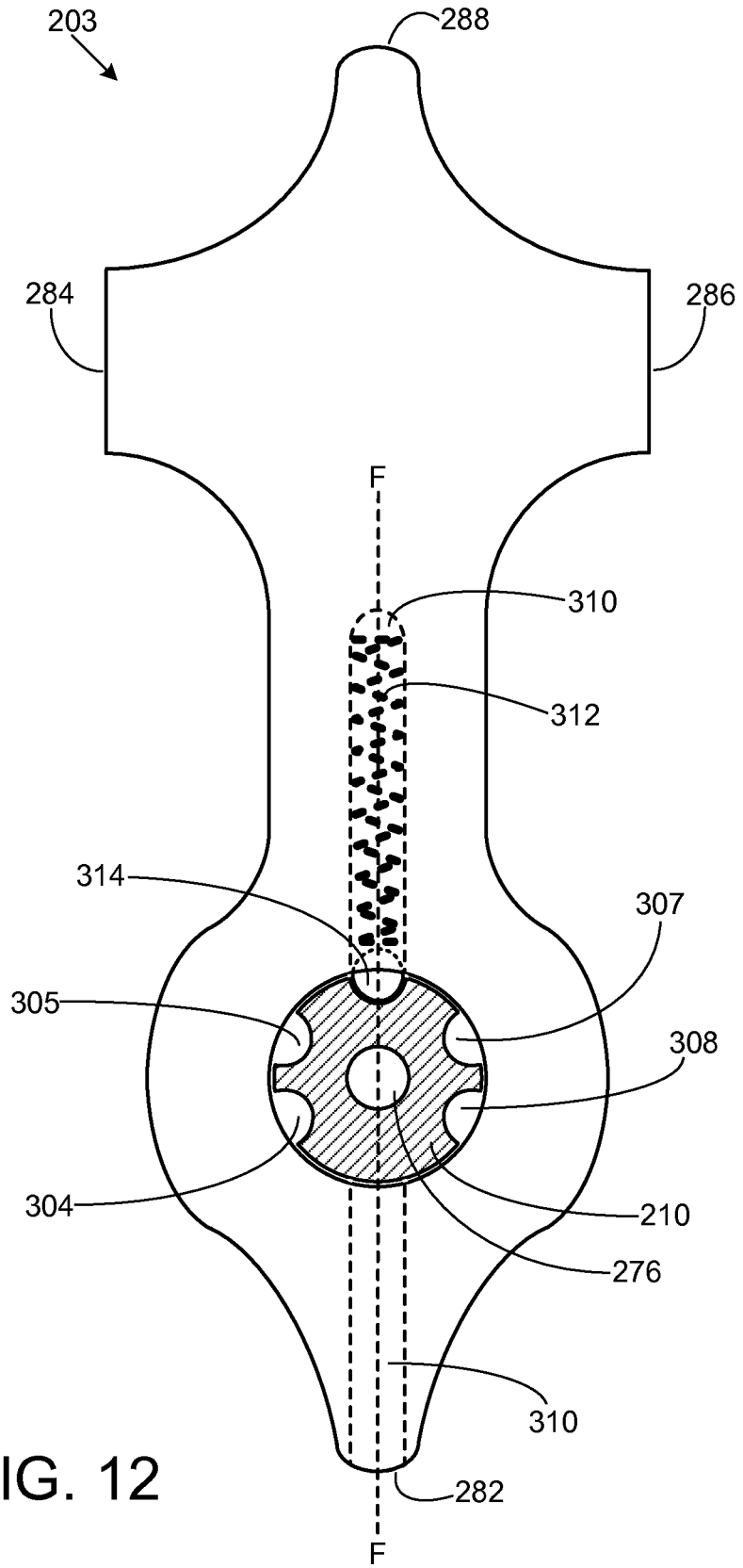
FIG. 12 is a diagram illustrating an enlarged view, in simplified form, of the string-contacting member of FIG. 10B rotatably disposed on the shaft of FIG. 9B.

FIG. 4A illustrates a standalone transparent plan view of an exemplary embodiment of a left jaw 208 of the clamp of FIG. 2. FIG. 4B illustrates a transparent plan view of the left jaw 208 of FIG. 4A rotated left 90 degrees. FIG. 5A illustrates a standalone transparent plan view of an exemplary embodiment of a collar 216 of the clamp of FIG. 2. FIG. 5B illustrates a plan view of the collar 216 of FIG. 5A rotated left 90 degrees. FIG. 6A illustrates a standalone transparent plan view of an exemplary embodiment of a right jaw 224 of the clamp of FIG. 2. FIG. 6B illustrates a transparent plan view of the right jaw 224 of FIG. 6A rotated right 90 degrees. FIG. 7A illustrates a standalone plan view of an exemplary embodiment of a jaw-tightening member 228 of the clamp of FIG. 2. FIG. 7B illustrates a plan view of the jaw-tightening member 228 of FIG. 7A rotated right 90 degrees. FIG. 8A illustrates a standalone plan view of an exemplary embodiment of a collar-tightening member 222 of the clamp of FIG. 2. FIG. 8B illustrates a plan view of the collar-tightening member 222 of FIG. 8A rotated right 90 degrees. FIG. 9A illustrates a standalone plan view of an exemplary embodiment of a first shaft 210 of the clamp of FIG. 2. FIG. 9B illustrates a cross-sectional view of the first shaft 210 taken along line B-B of FIG. 9A. FIG. 10A illustrates a standalone transparent plan view of an exemplary embodiment of one of the string-contacting members (e.g., member 203) of FIG. 2. FIG. 10B illustrates a transparent plan view of the string-contacting member 203 of FIG. 10A rotated right 90 degrees. FIG. 12 illustrates an enlarged view, in simplified form, of the string-contacting member 203 of FIG. 10B rotatably disposed on the first shaft 210 of FIG. 9B.

Generally speaking, and as exemplified in FIG. 2 and referring again to FIG. 1, the clamp of the tuning apparatus 200 is adapted to removably attach to a desired longitudinal position on the elongated neck 114 of the stringed musical instrument. In other words, the neck-gripping means serves to removably attach the capo to the neck. One possible example, among many others, of such as desired longitudinal position is indicated by line A-A in FIG. 1. Each of the string-contacting members 202-207 is rotatably supported by the clamp and is adapted to rotate thereon independently of the other string-contacting members. In other words, each of the string-depressing means rotates on the neck-gripping means independently of the other string-depressing means. This rotation occurs along a plane which is substantially parallel to the longitudinal axis of the neck, and hence is substantially parallel to either a given string or course of strings.

Referring again to FIGS. 1 and 2, each of the string-contacting members 202-207 is further adapted to adjustably impinge upon and urge the given string (e.g., string 130) or course of strings (not shown) toward a user-selectable one of three different longitudinal positions on the front surface 122 of the elongated neck 114. In other words, the plurality of string-depressing means generally serves to adjustably impinge upon and urge the strings of the stringed musical instrument toward a user-selectable one of three different longitudinal positions on the front surface of the neck. As will now be described in more detail, the first of these positions is a home position. The second of these positions is a home−1 position which is closer to the headstock 116 end of the neck than the home position. The third of these positions is a home+1 position which is farther from the headstock end of the neck than the home position. In an exemplary embodiment of the tuning apparatus 200 described herein, in the aforementioned case where the tuning apparatus is removably attached to the longitudinal position on the neck indicated by line A-A, the home position can also generally be indicated by line A-A, the home−1 position can generally be indicated by line D-D, and the home+1 position can generally be indicated by line E-E.

Referring again to FIG. 2, in one embodiment of the tuning apparatus 200 described herein the clamp of the tuning apparatus includes the aforementioned left jaw 208, first shaft 210, collar 216, collar-tightening member 222, right jaw 224, and jaw-tightening member 228. As exemplified in FIG. 9A, the first shaft includes a left end 212 and a right end 214. The left end of the first shaft is rigidly attached to an upper portion of the left jaw. By way of example but not limitation and as exemplified in FIG. 4B, the left end of the first shaft can be rigidly attached to the left jaw in the position indicated by dashed circle 262. It will be appreciated that this rigid attachment can be implemented in various ways. By way of example but not limitation, in an exemplary embodiment of the tuning apparatus the left end of the first shaft is press-fit into a mating aperture (not shown) located in the position indicated by dashed circle 262.

Generally speaking and referring again to FIGS. 2 and 9A, and as exemplified in FIG. 9B, the collar-tightening member 222 is rotatably attached to the right end 214 of the first shaft 210, where the collar-tightening member is adapted to adjustably push the collar toward a rightmost string-contacting member 207 so as to tighten the plurality of string-contacting members 202-207 in their current respective rotational positions. It will be appreciated that this rotatable attachment can be implemented in various ways. By way of example but not limitation, in the exemplary embodiment of the collar-tightening member illustrated in FIGS. 8A and 8B and the exemplary embodiment of the first shaft illustrated in FIGS. 9A and 9B, this rotational attachment is implemented as follows. The first shaft has a longitudinal axis C-C. The right end of the first shaft includes a first threaded aperture 276 having a longitudinal axis which is substantially aligned with the axis C-C. The collar-tightening member includes a first knob 278 and a threaded shaft 280 which is adapted to be threadably attached to the first threaded aperture 276. One end of the threaded shaft is rigidly disposed onto the first knob. The other end 250 of the threaded shaft is rotatably and threadably attached to the first threaded aperture 276 after the collar 216 has been slidably disposed onto the right end of the first shaft. In the exemplary embodiment of the collar-tightening member illustrated in FIGS. 8A and 8B a T-style knob is employed for the first knob. However, it will be appreciated that alternate embodiments of the collar-tightening member are also possible in which other shapes and styles of knobs are employed for the first knob.

Referring again to FIGS. 2 and 9A, and as exemplified in FIGS. 5A and 5B, an upper portion of the collar 216 includes a shaft-accepting aperture 218 which is adapted to allow the upper portion of the collar to be slidably disposed onto the right end 214 of the first shaft 210. A lower portion of the collar includes a first alignment feature 220 which runs substantially parallel to the shaft-accepting aperture 218. It will be appreciated that various types of alignment features can be employed for the first alignment feature. By way of example but not limitation, in the exemplary embodiment of the collar illustrated in FIGS. 5A and 5B the first alignment feature includes a dovetail-shaped tab which protrudes radially away from the shaft-accepting aperture 218. As exemplified in FIGS. 6A and 6B, an upper portion of the right jaw 224 includes a second alignment feature 226 which is adapted to allow the upper portion of the right jaw to be slidably disposed onto the first alignment feature on the collar. In the just described case where the first alignment feature includes the dovetail-shaped tab, the second alignment feature will include a dovetail-shaped channel which is adapted to slidably mate with the dovetail-shaped tab as illustrated in FIGS. 6A and 6B.

Generally speaking and referring again to FIG. 2, the jaw-tightening member 228 is rotatably attached to both a lower portion of the left jaw 208 and a lower portion of the right jaw 224, where the jaw-tightening member is adapted to adjustably push the right jaw toward the left jaw so as to securely grip the elongated neck 114 when it is disposed between the left jaw and right jaw. As will be appreciated from the more detailed description that follows, this gripping of the neck by the left and right jaws is controlled independently of the aforementioned tightening of the plurality of string-contacting members 202-207. It will be appreciated that this rotatable attachment can be implemented in various ways. By way of example but not limitation, in the exemplary embodiment of the jaw-tightening member illustrated in FIGS. 7A and 7B, the exemplary embodiment of the left jaw illustrated in FIGS. 4A and 4B, and the exemplary embodiment of the right jaw illustrated in FIGS. 6A and 6B, this rotatable attachment is implemented as follows.

Referring again to FIGS. 2, 4A, 4B, 5A, 5B, 6A, 6B, 7A and 7B, the lower portion of the left jaw 208 includes a second threaded aperture 230 which is substantially parallel to the first shaft 210. The jaw-tightening member 228 includes a second knob 232 and a second shaft 234 which has a threaded side 236 and an unthreaded side 238. The threaded side of the second shaft has a diameter D1 and is adapted to be threadably attached to the second threaded aperture 230. The unthreaded side of the second shaft has a diameter D2 which is greater than the diameter D1. The second knob is rigidly disposed onto the unthreaded side of the second shaft. The lower portion of the right jaw 224 includes an unthreaded aperture 240 which passes completely through the lower portion of the right jaw. The unthreaded aperture 240 has a diameter D3 which is greater than the diameter D1 but less than the diameter D2. The unthreaded aperture 240 is substantially parallel to the first shaft whenever the upper portion of the collar 216 is slidably disposed onto the right end of the first shaft and the second alignment feature 226 on the upper portion of the right jaw is slidably disposed onto the first alignment feature 220 on the lower portion of the collar. The threaded side of the second shaft is first rotatably disposed through the unthreaded aperture 240 and then rotatably and threadably attached to the second threaded aperture 230.

Referring again to FIGS. 7A and 7B, in the exemplary embodiment of the jaw-tightening member 228 that is illustrated in these FIGs. the second knob 232 has a circular shape. In order to enhance the user's ability to grasp and rotate the second knob, a radially outer surface of the second knob optionally can be either knurled (not shown), or can include a plurality of radially spaced depressions (not shown). However, it will be appreciated that alternate embodiments of the jaw-tightening member are also possible in which other shapes are employed for the second knob and other types of features are employed on its radially outer surface.

Referring again to FIGS. 2, 4A, 4B, 5A, 5B, 6A and 6B, the left jaw 208 can optionally include one or more guide pins (two in the illustrated embodiment, namely a first guide pin 242 and a second guide pin 244) which are rigidly attached to the lower portion of the left jaw such that each of the guide pins is substantially parallel to the first shaft 210 and projects toward the right jaw 224. The lower portion of the right jaw can correspondingly optionally include one or more guide-pin-accepting apertures (two in the illustrated embodiment, namely a first guide-pin-accepting aperture 246 and a second guide-pin-accepting aperture 248), where the number of guide-pin-accepting apertures equals the number of guide pins. Each of the guide-pin-accepting apertures is substantially parallel to the first shaft whenever the upper portion of the collar 216 is slidably disposed onto the right end 214 of the first shaft and the second alignment feature 226 on the right jaw is slidably disposed onto the first alignment feature 220 on the collar. Each of the guide-pin-accepting apertures is adapted to slidably receive a different guide pin whenever the upper portion of the collar is slidably disposed onto the right end of the first shaft, the second alignment feature on the right jaw is slidably disposed onto the first alignment feature on the collar, and the right jaw is pushed toward the left jaw by the jaw-tightening member 228. It will thus be appreciated the guide pins and guide-pin-accepting apertures operate cooperatively to aid in aligning the left and right jaws whenever the tuning apparatus 200 is removably attached to the elongated neck 114.

Referring again to FIGS. 2, 4A, 4B, 6A and 6B, the left jaw 208 also includes a left neck-contacting surface 258 which is adapted to snugly grip a left edge of the elongated neck 114. Correspondingly, the right jaw 224 includes a right neck-contacting surface 260 which is adapted to snugly grip a right edge of the neck. These left and right neck-contacting surfaces operate cooperatively to maintain the first shaft 210 in substantially parallel spaced relation to the front surface 122 of the neck, and maintain the first shaft in substantially perpendicular spaced relation to the plurality of strings 130-135. The left neck-contacting surface includes one or more right-facing tabs (two in the illustrated embodiment, namely a first right-facing tab 264 and a second right-facing tab 266) and a first flexible pad 268. The right-facing tabs are rigidly disposed onto the left jaw beneath the first shaft and above the jaw-tightening member 228 such that the right-facing tabs project toward the right jaw. The first flexible pad is securely disposed onto the left jaw beneath the right-facing tabs and above the jaw-tightening member. The first flexible pad is adapted to conform to the shape of a bottom portion of the left edge of the neck as exemplified in FIG. 2. The right neck-contacting surface includes one or more left-facing tabs (two in the illustrated embodiment, namely a first left-facing tab 270 and a second left-facing tab 272) and a second flexible pad 274. The left-facing tabs are rigidly disposed onto the right jaw beneath the second alignment feature 226 and above the jaw-tightening member such that the left-facing tabs project toward the left jaw. The second flexible pad is securely disposed onto the right jaw beneath the left-facing tabs and above the jaw-tightening member. The second flexible pad is adapted to conform to the shape of a bottom portion of the right edge of the neck as exemplified in FIG. 2.

As described heretofore and referring again to FIGS. 1 and 2, the front surface 122 of the elongated neck 114 can include a plurality of frets (e.g., frets 128, 126, 102 and 124) which are sequentially arranged on the front surface and are substantially perpendicular to the longitudinal axis of the neck. Generally speaking, in the capo embodiments described herein one of the frets is considered to be a home fret. Another one of the frets is considered to be a home−1 fret, where the home−1 fret is adjacent to the home fret on the headstock 116 end of the neck. Yet another one of the frets is considered to be a home+1 fret, where the home+1 fret is adjacent to the home fret on a side thereof that is opposite the home−1 fret. More particularly, in the exemplary embodiment of the tuning apparatus 200 described herein where the tuning apparatus is removably attached to the longitudinal position on the neck indicated by line A-A, this position includes the first shaft 210 being substantially parallel to and approximately midway between the home fret 126 and home−1 fret 128.

Referring again to FIGS. 1 and 2, and as exemplified in FIGS. 3, 10A and 10B, each of the string-contacting members 202-207 is implemented as a longitudinal cam. Each of the string-contacting members includes a home string-contacting surface 282 which is adapted to impinge upon the aforementioned given string or course of strings and urge this string or course toward the home position on the front surface 122 of the elongated neck 114 (e.g., the position indicated by line A-A in FIG. 1) whenever the string-contacting member is retainably but releasably engaged into the home rotational orientation so as to depress the string or course onto the home fret (e.g., fret 126 in FIG. 1). By way of example but not limitation, in FIG. 3 string-contacting member 203 is illustrated to be in the home rotational orientation. By way of further example, in FIG. 2 all six of the string-contacting members 202-207 are illustrated to be in the home rotational orientation, where the home string-contacting surface of member 202 is impinging upon string 130 and urging it toward the home position on the front surface of the neck, the home string-contacting surface of member 203 is impinging upon string 131 and urging it toward this home position, the home string-contacting surface of member 204 is impinging upon string 132 and urging it toward this home position, the home string-contacting surface of member 205 is impinging upon string 133 and urging it toward this home position, the home string-contacting surface of member 206 is impinging upon string 134 and urging it toward this home position, and the home string-contacting surface of member 207 is impinging upon string 135 and urging it toward this home position.

Referring again to FIGS. 1 and 2, 3, 10A and 10B, each of the string-contacting members 202-207 also includes a home−1 string-contacting surface 284 which is adapted to impinge upon the given string or course of strings and urge this string or course toward the home−1 position on the front surface 122 of the elongated neck 114 (e.g., the position indicated by line D-D in FIG. 1) whenever the string-contacting member is retainably but releasably engaged into the home−1 rotational orientation so as to depress the string or course onto the home−1 fret (e.g., fret 128 in FIG. 1). By way of example but not limitation, in FIG. 3 string-contacting member 202 is illustrated to be in the home−1 rotational orientation. Each of the string-contacting members also includes a home+1 string-contacting surface 286 which is adapted to impinge upon the given string or course of strings and urge this string or course toward the home+1 position on the front surface of the neck (e.g., the position indicated by line E-E in FIG. 1) whenever the string-contacting member is retainably but releasably engaged into the home+1 rotational orientation so as to depress the string or course onto the home+1 fret (e.g., fret 102 in FIG. 1). By way of example but not limitation, in FIG. 3 string-contacting member 204 is illustrated to be in the home+1 rotational orientation. Each of the string-contacting members also includes a handle 288 which is adapted to allow the user to use one or more fingers to change the rotational orientation of the string-contacting member at will.

Referring again to FIGS. 2, 3, 9A, 9B, 10A and 10B, an exemplary manner in which the string-contacting members 202-207 are retainably but releasably engaged into the various rotational orientations described herein will now be described in more detail. In an exemplary embodiment of the tuning apparatus 200 described herein the first shaft 210 also includes a radially outer surface 302, a radial axis G-G which is perpendicular to the front surface 122 of the elongated neck 114, and a plurality of longitudinal grooves 304-308 which are generally disposed in different radial positions on the outer surface 302. Each of the string-contacting members also includes a longitudinal cavity 310 having a longitudinal axis F-F which substantially intersects the longitudinal axis C-C of the first shaft. As exemplified in FIG. 12, each of the string-contacting members also includes a spring-loaded 312 ball bearing 314 which is disposed within the longitudinal cavity and is adapted to locate into a given one of the longitudinal grooves whenever the spring-contacting member is rotated about the first shaft by the user.

Referring again to FIGS. 3, 9A, 9B and 12, the longitudinal grooves include a home groove 306, a home−1 groove 304, and a home+1 groove 308. The home groove 306 is disposed in a first radial position on the outer surface 302 of the first shaft 210 which is adapted to retainably but releasably engage each of the string-contacting members 202-207 into the home rotational orientation. The home−1 groove 304 is disposed in a second radial position on the outer surface which is adapted to retainably but releasably engage each of the string-contacting members into the home−1 rotational orientation. The home+1 groove 308 is disposed in a third radial position on the outer surface which is adapted to retainably but releasably engage each of the string-contacting members into the home+1 rotational orientation. The longitudinal grooves can optionally also include a headstock-side open-string groove 305 and a bridge-side open-string groove 307. The headstock-side open-string groove is disposed in a fourth radial position on the outer surface which is adapted to retainably but releasably engage each of the string-contacting members into the aforementioned optional headstock-side open-string rotational orientation. The bridge-side open-string groove is disposed in a fifth radial position on the outer surface which is adapted to retainably but releasably engage each of the string-contacting members into the aforementioned optional bridge-side open-string rotational orientation.

Referring again to FIGS. 2 and 9B, it will be appreciated that the longitudinal grooves 304-308 can be disposed in various radial positions on the outer surface 302 of the first shaft 210. By way of example but not limitation, in the exemplary embodiment of the first shaft illustrated in FIG. 9B, the first radial position of the home groove 306 is substantially aligned with the radial axis G-G on the side of this axis which points away from the front surface 122 of the elongated neck 114. The second radial position of the home−1 groove 304 is 105 degrees away from the home groove on a headstock side of the tuning apparatus 200. The third radial position of the home+1 groove 308 is 105 degrees away from the home groove on a bridge side of the tuning apparatus. The fourth radial position of the headstock-side open-string groove 305 is 65 degrees away from the home groove on a headstock side of the tuning apparatus. The fifth radial position of the bridge-side open-string groove 307 is 65 degrees away from the home groove on a bridge side of the tuning apparatus.

Referring again to FIGS. 2, 3, 10A and 10B, in an exemplary embodiment of the tuning apparatus 200 described herein the home string-contacting surface 282 of each of the string-contacting members 202-207 includes a first pressure-sensitive pad (not shown) which is adapted to apply an appropriate amount of pressure to the given string or course of strings whenever the string-contacting member is in the home rotational orientation. The home−1 string-contacting surface 284 of each of the string-contacting members includes a second pressure-sensitive pad (not shown) which is adapted to apply an appropriate amount of pressure to the given string or course of strings whenever the string-contacting member is in the home−1 rotational orientation. The home+1 string-contacting surface 286 of each of the string-contacting members includes a third pressure-sensitive pad (not shown) which is adapted to apply an appropriate amount of pressure to the given string or course of strings whenever the string-contacting member is in the home+1 rotational orientation. It will thus be appreciated that the tuning apparatus ensures that the given string or course of strings remains securely "fretted" while the user is playing the instrument in any of a variety of playing styles (e.g., the given string/course will not "buzz"). It will also be appreciated that the pressure-sensitive nature of the pads results in the amount of pressure that is applied to the given string or course of strings being automatically adjusting so as to reliably depress the string/course onto a given fret without distorting the tuning of the string/course.

Given the foregoing, it will be appreciated that the capo embodiments described herein are universally adjustable and configurable to accommodate a wide variety of different types of stringed musical instruments. Examples of this universal adjustability and configurability include, but are not limited to, the following. As exemplified in FIG. 2, the tuning apparatus 200 can be configured such that the number of string-contacting members 202-207 equals the number of strings 130-135 on the stringed musical instrument. By way of example but not limitation, in the case where the instrument is a four-string bass guitar, the tuning apparatus would be configured with four string-contacting members. In the case where the instrument is a five-string bass guitar, the tuning apparatus would be configured with five string-contacting members. In the case where the instrument is either a six-string bass guitar or a six-string acoustic guitar, the tuning apparatus would be configured with six string-contacting members. In each of these cases, each of the string-contacting members would be substantially centered over a different string.

As described heretofore, the strings of a given stringed musical instrument can also be arranged into a plurality of courses where each of the courses includes a different and non-overlapping subset of the strings. In this situation the tuning apparatus would be configured such that the number of string-contacting members equals the number of courses on the instrument, and each of the string-contacting members would be substantially centered over a different course. By way of example but not limitation, in the case where the instrument is either a 12-string electric or acoustic guitar having six courses of strings each of which includes a different and non-overlapping pair of strings, the tuning apparatus would be configured with six string-contacting members.

The capo embodiments can be easily and quickly adjusted by the user to accommodate instruments having a variety of different neck widths. The capo embodiments can also be easily and quickly attached to different longitudinal positions on the instrument's neck to accommodate instruments having different fret locations and spacings. The capo embodiments can also be easily adapted to accommodate instruments having different spacings between the strings by slidably disposing one or more washers having a prescribed thickness onto the first shaft between adjacent pairs of string-contacting members as needed. The capo embodiments can also be easily adapted to accommodate instruments having different spacings between the left/right edge of the neck and the leftmost/rightmost string by inserting a washer having a prescribed thickness between the left/right jaw and the leftmost/rightmost string-contacting member. The pressure placed on the strings by the capo embodiments can be easily controlled by adjusting the placement of the capo embodiments on the neck in relation to the home fret, home−1 fret, and home+1 fret. It will thus be appreciated that such an adjustment allows the user to easily and quickly adapt the capo embodiments to accommodate instruments having a variety of actions.

It will also be appreciated that whenever a given string-contacting member is in any rotational orientation other than either the home rotational orientation or the home+1 rotational orientation, the user can use their finger to depress the given string or course of strings onto the home fret as desired. Additionally, the capo embodiments described herein can be made from a wide variety of different materials. By way of example but not limitation, the string-contacting members, left jaw, first shaft, right jaw, jaw-tightening member, collar, and collar-tightening member can each be made from any of a variety of rigid and durable materials such as aluminum, or brass, or other types of metals, or metal alloys, or ceramic, or plastic, or plastic composites, among others. The pressure-sensitive pads can be made from any of a variety of flexible but relatively stiff materials such as rubber or leather, among others.

2.1 Modified Right Jaw

An alternate embodiment of the tuning apparatus described herein is also possible where the collar and right jaw are integrated to form what is hereafter referred to as a "modified right jaw." As will be appreciated from the more detailed description that follows, the modified right jaw is fully compatible with the left jaw, first shaft, jaw-tightening member, and string-contacting members described herein. When the tuning apparatus is configured with the modified right jaw, the collar-tightening member need not be used and the right end of the first shaft need not include the first threaded aperture.

Figure 11A:
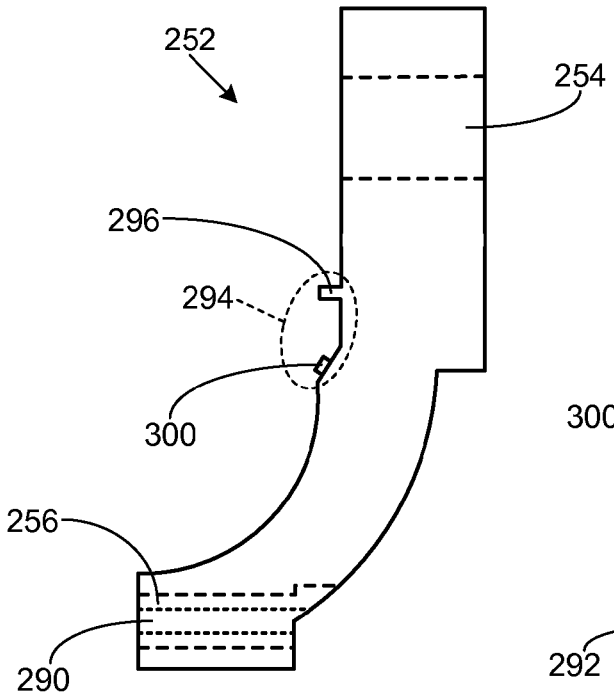
FIG. 11A is a diagram illustrating a standalone transparent plan view, in simplified form, of an exemplary embodiment of a modified right jaw.
Figure 11B:
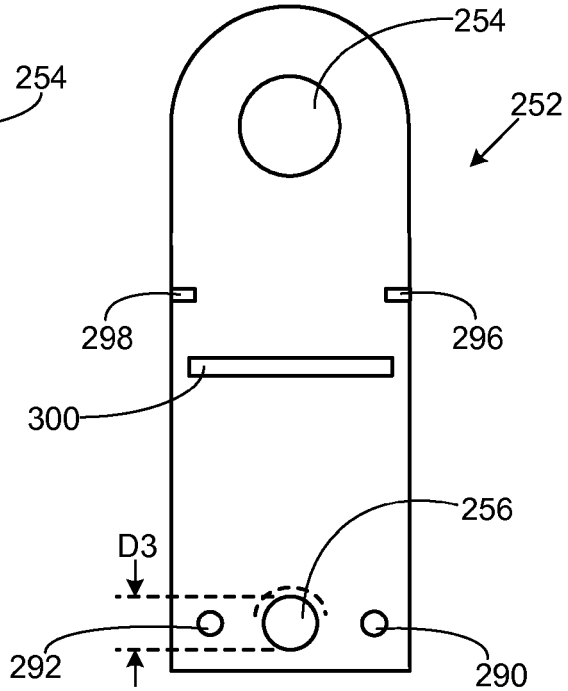
FIG. 11B is a diagram illustrating a transparent plan view, in simplified form, of the modified right jaw of FIG. 11A rotated right 90 degrees.

FIG. 11A illustrates a standalone transparent plan view, in simplified form, of an exemplary embodiment of the modified right jaw 252. FIG. 11B illustrates a transparent plan view, in simplified form, of the modified right jaw 252 of FIG. 11A rotated right 90 degrees. As exemplified in FIGS. 11A and 11B, an upper portion of the modified right jaw includes a shaft-accepting aperture 254 which is adapted to allow the upper portion of the modified right jaw to be slidably disposed onto the right end of the first shaft. The jaw-tightening member is rotatably attached to both the lower portion of the left jaw and a lower portion of the modified right jaw. The jaw-tightening member is adapted as described heretofore to adjustably push the modified right jaw toward the left jaw so as to securely grip the elongated neck of the stringed musical instrument when it is disposed between and left jaw and modified right jaw. It will be appreciated that this rotatable attachment of the jaw-tightening member to the left jaw and modified right jaw can be implemented in various ways. By way of example but not limitation, in an exemplary embodiment of the tuning apparatus described herein this rotatable attachment is implemented as follows.

Referring again to FIGS. 11A and 11B, the lower portion of the modified right jaw 252 includes an unthreaded aperture 256 which passes completely through the lower portion of the modified right jaw. The unthreaded aperture 256 has the aforementioned diameter D3 and is substantially parallel to the first shaft whenever the upper portion of the modified right jaw is slidably disposed onto the right end of the first shaft. The threaded side of the jaw-tightening member's second shaft is first rotatably disposed through the unthreaded aperture 256 and then rotatably and threadably attached to the second threaded aperture on the lower portion of the left jaw. In the aforementioned case where the left jaw includes the one or more guide pins, the lower portion of the modified right jaw will correspondingly include one or more guide-pin-accepting apertures (two in the illustrated embodiment, namely a first guide-pin-accepting aperture 290 and a second guide-pin-accepting aperture 292), where the number of guide-pin-accepting apertures equals the number of guide pins. Each of the guide-pin-accepting apertures is substantially parallel to the first shaft whenever the upper portion of the modified right jaw is slidably disposed onto the right end of the first shaft. Each of the guide-pin-accepting apertures is adapted to slidably receive a different guide pin whenever the upper portion of the modified right jaw is slidably disposed onto the right end of the first shaft, and the modified right jaw is pushed toward the left jaw by the jaw-tightening member.

Referring again to FIGS. 11A and 11B, the modified right jaw 252 includes a right neck-contacting surface 294 which is adapted to snugly grip the right edge of the elongated neck. The right neck-contacting surface includes one or more left-facing tabs (two in the illustrated embodiment, namely a first left-facing tab 296 and a second left-facing tab 298) and a flexible pad 300. The left-facing tabs are rigidly disposed onto the modified right jaw beneath the shaft-accepting aperture 254 and above the jaw-tightening member such that the left-facing tabs project toward the left jaw. The flexible pad is securely disposed onto the modified right jaw beneath the left-facing tabs and above the jaw-tightening member. The flexible pad is adapted to conform to the shape of the bottom portion of the right edge of the neck.

3.0 Additional Embodiments

While the capo has been described by specific reference to embodiments thereof, it is understood that variations and modifications thereof can be made without departing from the true spirit and scope of the capo. It is also noted that any or all of the aforementioned embodiments can be used in any combination desired to form additional hybrid embodiments. Although the capo embodiments have been described in language specific to structural features and/or methodological acts, it is to be understood that the subject matter defined in the appended claims is not necessarily limited to the specific features or acts described heretofore. Rather, the specific features and acts described heretofore are disclosed as example forms of implementing the claims.

Wherefore, what is claimed is:

1. A tuning apparatus for a musical instrument comprising an elongated neck comprising a front surface over which a plurality of strings is stretched, comprising:

a clamp which is adapted to removably attach to a desired longitudinal position on the neck; and a plurality of string-contacting members, wherein, each of the string-contacting members is rotatably supported by the clamp, each of the string-contacting members is adapted to rotate on the clamp independently of the other string-contacting members, said rotation occurring along a plane which is substantially parallel to either a given string or course of strings, and each of the string-contacting members is further adapted to adjustably impinge upon and urge the given string or course of strings toward a user-selectable one of three different longitudinal positions on the front surface of the neck, said positions comprising a home position, a home−1 position which is closer to a headstock end of the neck than the home position, and a home+1 position which is farther from the headstock end of the neck than the home position.

2. The apparatus of claim 1, wherein the clamp comprises:

a left jaw;

a first shaft comprising a left end and a right end, wherein the left end of the first shaft is rigidly attached to an upper portion of the left jaw;

a right jaw, wherein an upper portion of the right jaw comprises a shaft-accepting aperture which is adapted to allow the upper portion of the right jaw to be slidably disposed onto the right end of the first shaft; and a tightening member which is rotatably attached to both a lower portion of the left jaw and a lower portion of the right jaw, wherein the tightening member is adapted to adjustably push the right jaw toward the left jaw so as to securely grip the neck when it is disposed between the left jaw and right jaw.

3. The apparatus of claim 2, wherein, the lower portion of the left jaw comprises a threaded aperture which is substantially parallel to the first shaft, the tightening member comprises a knob and a second shaft, the second shaft comprises a threaded side and an unthreaded side, the threaded side of the second shaft comprises a diameter D1 and is adapted to be threadably attached to said threaded aperture, the unthreaded side of the second shaft comprises a diameter D2 which is greater than the diameter D1, the knob is rigidly disposed onto the unthreaded side of the second shaft, the lower portion of the right jaw comprises an unthreaded aperture which passes completely through said lower portion, said unthreaded aperture comprises a diameter D3 which is greater than the diameter D1 but less than the diameter D2, said unthreaded aperture is substantially parallel to the first shaft whenever the upper portion of the right jaw is slidably disposed onto the right end of the first shaft, and the threaded side of the second shaft is first rotatably disposed through said unthreaded aperture and then rotatably and threadably attached to said threaded aperture.

4. The apparatus of claim 2, wherein, the left jaw comprises one or more guide pins which are rigidly attached to the lower portion of the left jaw such that each of the guide pins is substantially parallel to the first shaft and projects toward the right jaw, the lower portion of the right jaw further comprises one or more guide-pin-accepting apertures, the number of guide-pin-accepting apertures equals the number of guide pins, each of the guide-pin-accepting apertures is substantially parallel to the first shaft whenever the upper portion of the right jaw is slidably disposed onto the right end of the first shaft, and each of the guide-pin-accepting apertures is adapted to slidably receive a different guide pin whenever the upper portion of the right jaw is slidably disposed onto the right end of the first shaft and the right jaw is pushed toward the left jaw by the tightening member.

5. The apparatus of claim 2, wherein, the left jaw comprises a left neck-contacting surface which is adapted to snugly grip a left edge of the neck, the right jaw comprises a right neck-contacting surface which is adapted to snugly grip a right edge of the neck, and the left and right neck-contacting surfaces operate cooperatively to maintain the first shaft in substantially parallel spaced relation to the front surface of the neck, and maintain the first shaft in substantially perpendicular spaced relation to the plurality of strings.

6. The apparatus of claim 1, wherein the clamp comprises:

a left jaw;

a first shaft comprising a left end and a right end, wherein the left end of the first shaft is rigidly attached to an upper portion of the left jaw;

a collar, wherein an upper portion of the collar comprises a shaft-accepting aperture which is adapted to allow the upper portion of the collar to be slidably disposed onto the right end of the first shaft, and a lower portion of the collar comprises a first alignment feature which runs substantially parallel to the shaft-accepting aperture;

a first tightening member which is rotatably attached to the right end of the first shaft, wherein the first tightening member is adapted to adjustably push the collar toward a rightmost string-contacting member so as to tighten the plurality of string-contacting members in their current respective rotational positions;

a right jaw, wherein an upper portion of the right jaw comprises a second alignment feature which is adapted to allow the upper portion of the right jaw to be slidably disposed onto the first alignment feature on the collar; and a second tightening member which is rotatably attached to both a lower portion of the left jaw and a lower portion of the right jaw, wherein the second tightening member is adapted to adjustably push the right jaw toward the left jaw so as to securely grip the neck when it is disposed between the left jaw and right jaw, and said gripping of the neck is controlled independently of said tightening of the plurality of string-contacting members.

7. The apparatus of claim 6, wherein, the first alignment feature comprises a dovetail-shaped tab which protrudes radially away from the shaft-accepting aperture, and the second alignment feature comprises a dovetail-shaped channel which is adapted to slidably mate with the dovetail-shaped tab.

8. The apparatus of claim 6, wherein, the lower portion of the left jaw comprises a threaded aperture which is substantially parallel to the first shaft, the second tightening member comprises a knob and a second shaft, the second shaft comprises a threaded side and an unthreaded side, the threaded side of the second shaft comprises a diameter D1 and is adapted to be threadably attached to said threaded aperture, the unthreaded side of the second shaft comprises a diameter D2 which is greater than the diameter D1, the knob is rigidly disposed onto the unthreaded side of the second shaft, the lower portion of the right jaw comprises an unthreaded aperture which passes completely through said lower portion, said unthreaded aperture comprises a diameter D3 which is greater than the diameter D1 but less than the diameter D2, said unthreaded aperture is substantially parallel to the first shaft whenever the upper portion of the collar is slidably disposed onto the right end of the first shaft and the second alignment feature on the right jaw is slidably disposed onto the first alignment feature on the collar, and the threaded side of the second shaft is first rotatably disposed through said unthreaded aperture and then rotatably and threadably attached to said threaded aperture.

9. The apparatus of claim 6, wherein, the left jaw comprises one or more guide pins which are rigidly attached to the lower portion of the left jaw such that each of the guide pins is substantially parallel to the first shaft and projects toward the right jaw, the lower portion of the right jaw further comprises one or more guide-pin-accepting apertures, the number of guide-pin-accepting apertures equals the number of guide pins, each of the guide-pin-accepting apertures is substantially parallel to the first shaft whenever the upper portion of the collar is slidably disposed onto the right end of the first shaft and the second alignment feature on the right jaw is slidably disposed onto the first alignment feature on the collar, and each of the guide-pin-accepting apertures is adapted to slidably receive a different guide pin whenever the upper portion of the collar is slidably disposed onto the right end of the first shaft, the second alignment feature on the right jaw is slidably disposed onto the first alignment feature on the collar, and the right jaw is pushed toward the left jaw by the second tightening member.

10. The apparatus of claim 6, wherein, the first shaft comprises a longitudinal axis C-C, the right end of the first shaft comprises a threaded aperture comprising a longitudinal axis which is substantially aligned with the axis C-C, the first tightening member comprises a knob and a threaded shaft, the threaded shaft is adapted to be threadably attached to the threaded aperture, one end of the threaded shaft is rigidly disposed onto the knob, and the other end of the threaded shaft is rotatably and threadably attached to the threaded aperture after the collar has been slidably disposed onto the right end of the first shaft.

11. The apparatus of claim 6, wherein, the left jaw comprises a left neck-contacting surface which is adapted to snugly grip a left edge of the neck, the right jaw comprises a right neck-contacting surface which is adapted to snugly grip a right edge of the neck, and the left and right neck-contacting surfaces operate cooperatively to maintain the first shaft in substantially parallel spaced relation to the front surface of the neck, and maintain the first shaft in substantially perpendicular spaced relation to the plurality of strings.

12. The apparatus of claim 11, wherein, the left neck-contacting surface comprises one or more right-facing tabs and a first flexible pad which is adapted to conform to a shape of a bottom portion of the left edge of the neck, the right-facing tabs being rigidly disposed onto the left jaw beneath the first shaft and above the second tightening member such that the right-facing tabs project toward the right jaw, the first flexible pad being securely disposed onto the left jaw beneath the right-facing tabs and above the second tightening member, and the right neck-contacting surface comprises one or more left-facing tabs and a second flexible pad which is adapted to conform to a shape of a bottom portion of the right edge of the neck, the left-facing tabs being rigidly disposed onto the right jaw beneath the second alignment feature and above the second tightening member such that the left-facing tabs project toward the left jaw, the second flexible pad being securely disposed onto the right jaw beneath the left-facing tabs and above the second tightening member.

13. The apparatus of claim 1, wherein, the front surface of the neck comprises a home fret, a home−1 fret and a home+1 fret, said frets being sequentially arranged on said surface and substantially perpendicular to a longitudinal axis of the neck, the home−1 fret is adjacent to the home fret on the headstock end of the neck, the home+1 fret is adjacent to the home fret on a side thereof that is opposite the home−1 fret, the clamp comprises a shaft, the desired longitudinal position on the neck comprises the shaft being substantially parallel to and approximately midway between the home and home−1 frets, each of the string-contacting members comprises a home string-contacting surface, a home−1 string-contacting surface, and a home+1 string-contacting surface, the home string-contacting surface is adapted to impinge upon the given string or course of strings and urge said string or course toward the home position on said surface whenever the string-contacting member is retainably but releasably engaged into a home rotational orientation so as to depress said string or course onto the home fret, the home−1 string-contacting surface is adapted to impinge upon said string or course and urge said string or course toward the home−1 position on said surface whenever the string-contacting member is retainably but releasably engaged into a home−1 rotational orientation so as to depress said string or course onto the home−1 fret, and the home+1 string-contacting surface is adapted to impinge upon said string or course and urge said string or course toward the home+1 position on said surface whenever the string-contacting member is retainably but releasably engaged into a home+1 rotational orientation so as to depress said string or course onto the home+1 fret.

14. The apparatus of claim 13, wherein, the shaft comprises a radially outer surface, a longitudinal axis C-C, and plurality of longitudinal grooves which are disposed in different radial positions on said outer surface, each of the string-contacting members further comprises a longitudinal cavity and a spring-loaded ball bearing, the cavity comprises a longitudinal axis F-F which substantially intersects axis C-C, the spring-loaded ball bearing is disposed within the cavity and is adapted to locate into a given one of the longitudinal grooves whenever the string-contacting member is rotated about the shaft by the user, the longitudinal grooves comprise a home groove, a home−1 groove, and a home+1 groove, the home groove is disposed in a first radial position which is adapted to retainably but releasably engage the string-contacting member into the home rotational orientation, the home−1 groove is disposed in a second radial position which is adapted to retainably but releasably engage the string-contacting member into the home−1 rotational orientation, and the home+1 groove is disposed in a third radial position which is adapted to retainably but releasably engage the string-contacting member into the home+1 rotational orientation.

15. The apparatus of claim 14, wherein, the longitudinal grooves further comprise a headstock-side open-string groove and a bridge-side open-string groove, the headstock-side open-string groove is disposed in a fourth radial position which is adapted to retainably but releasably engage the string-contacting member into a headstock-side open-string rotational orientation, and the bridge-side open-string groove is disposed in a fifth radial position which is adapted to retainably but releasably engage the string-contacting member into a bridge-side open-string rotational orientation.

16. The apparatus of claim 13, wherein, the home string-contacting surface comprises a first pressure-sensitive pad which is adapted to apply an appropriate amount of pressure to the given string or course of strings whenever the string-contacting member is in the home rotational orientation, the home−1 string-contacting surface comprises a second pressure-sensitive pad which is adapted to apply an appropriate amount of pressure to said string or course whenever the string-contacting member is in the home−1 rotational orientation, and the home+1 string-contacting surface comprises a third pressure-sensitive pad which is adapted to apply an appropriate amount of pressure to said string or course whenever the string-contacting member is in the home+1 rotational orientation.

17. The apparatus of claim 13, wherein each of the string-contacting members further comprises a handle which is adapted to allow the user to use one or more fingers to change the rotational orientation of said member at will.

18. The apparatus of claim 1, wherein, the number of string-contacting members equals the number of strings, and each of the string-contacting members is substantially centered over a different string.

19. The apparatus of claim 1, wherein, the strings are arranged into a plurality of courses, each of the courses comprises a different and non-overlapping subset of the strings, the number of string-contacting members equals the number of courses, and each of the string-contacting members is substantially centered over a different course.

20. A capo for a stringed musical instrument, comprising:

a neck-gripping means for removably attaching the capo to an elongated neck of the instrument; and a plurality of string-depressing means for adjustably impinging upon and urging strings of the instrument toward a user-selectable one of three different longitudinal positions on a front surface of the elongated neck, wherein, each of the string-depressing means rotates on the neck-gripping means independently of the other string-depressing means, said rotation occurs along a plane which is substantially parallel to either a given string or course of strings, and said longitudinal positions comprise a home position, a home−1 position which is closer to a headstock end of the elongated neck than the home position, and a home+1 position which is farther from the headstock end of the elongated neck than the home position.

* * * * *